US008636442B1

(12) United States Patent
Sopko, Jr. et al.

(10) Patent No.: US 8,636,442 B1
(45) Date of Patent: Jan. 28, 2014

(54) INTEGRATED GENERATOR FOR SCREED PLATE HEAT UP

(71) Applicant: Caterpillar Paving Products, Inc., Brooklyn Park, MN (US)

(72) Inventors: Thomas M. Sopko, Jr., East Peoria, IL (US); Ryan T. Thiesse, Otsego, MN (US); Robert J. Lord, Waukesha, WI (US); Toby A. Frelich, Saint Michael, MN (US); Edward Lee Zwilling, Washington, IL (US); Robert Wayne Lindsey, Washington, IL (US); Rodwan T. Adra, Peoria, IL (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/715,439

(22) Filed: Dec. 14, 2012

(51) Int. Cl.
*E01C 23/14* (2006.01)
*E01C 19/22* (2006.01)

(52) U.S. Cl.
USPC ..... 404/79; 404/77; 404/118; 701/50

(58) Field of Classification Search
USPC ..... 404/77, 79, 118; 701/50
See application file for complete search history.

(56) References Cited

U.S. PATENT DOCUMENTS

| | | | | |
|---|---|---|---|---|
| 6,421,594 | B1 * | 7/2002 | Erasmus | 701/50 |
| 6,981,820 | B2 | 1/2006 | Nelson | |
| 7,641,419 | B1 | 1/2010 | Nelson | |
| 7,856,302 | B2 | 12/2010 | Rasmussen | |
| 7,993,075 | B2 * | 8/2011 | Nelson | 404/77 |
| 8,297,875 | B1 * | 10/2012 | Kopacz et al. | 404/77 |
| 2009/0154995 | A1 | 6/2009 | Schneider et al. | |
| 2009/0257825 | A1 | 10/2009 | Nelson | |
| 2010/0178107 | A1 | 7/2010 | Braddy et al. | |
| 2010/0296866 | A1 | 11/2010 | Braun et al. | |
| 2012/0087726 | A1 | 4/2012 | Smieja | |
| 2013/0142571 | A1 * | 6/2013 | Graham et al. | 404/118 |

OTHER PUBLICATIONS

Susitra, et al.; *Switched Reluctance Generator—Modeling, Design, Simulation, Analysis and Control a Comprehensive Review*; journal; 2010; pp. 10-16; vol. 1—No. 2; International Journal of Computer Applications.

Hrabovcova, et al.; *Output Power of Switched Reluctance Generator with Regard to the Phase Number and Number of Stator and Rotor Poles*; article; 2011; pp. 25-30; Electronics and Electrical Engineering.

Pavement Interactive; *Asphalt Paver*; website; Apr. 7, 2009; pp. 1-5.

Caterpillar; *AP655D Asphalt Paver*; catalog; 2007; pp. 1-12.

Caterpillar; *AS2302C VERS-A-MAT™ Vibratory Screed*; catalog; 2011; pp. 1-12.

Caterpillar; *AS2252C VERS-A-MAT™ Asphalt Creed*; catalog; 2008; pp. 1-8.

* cited by examiner

*Primary Examiner* — Raymond W Addie
(74) *Attorney, Agent, or Firm* — Miller, Matthias & Hull

(57) ABSTRACT

A paving machine for laying a mat of paving material on a paving surface includes a generator, such as a switched reluctance generator, integrally installed with a pump drive and operatively connected to an output shaft of a power source of the paving machine. The generator outputs AC power to a power converter that in turn outputs DC power for a plurality of screed heating elements to produce heat to warm a screed. The paving machine may also include an insulation monitoring system for determining the occurrences of ground faults in the electrical components by comparing current levels in the components to a predetermined maximum current level. A controller of the paving machine may monitor the temperature of the generator and produce the speed of the power source to prevent overheating.

22 Claims, 4 Drawing Sheets

INTEGRATED GENERATOR FOR SCREED PLATE HEAT UP

TECHNICAL FIELD

The present disclosure is generally directed to paving machines operating to lay a mat of paving material on a paving surface and, more particularly, to improving the efficiency and reliability of heating a paving screed of the paving machine to an optimal temperature for laying the mat on the paving surface.

BACKGROUND

When building roadways, parking lots and the like, for example, paving machines may be used to deposit paving material, such as asphalt, on a paving surface to create a flat, consistent surface over which vehicles will travel. A paving machine at the construction site, such as an asphalt paver, is generally a state-of-the art self-propelled construction machine designed to receive, convey, distribute, profile and partially compact the asphalt material. The paving machine accepts asphalt material that is heated to an appropriate temperature for flow and even spreading into a receiving hopper at the front of the machine. The asphalt material in the hopper is conveyed to the rear of the machine with parallel slat conveyors or other types of conveyors positioned at the bottom of the hopper. The asphalt material conveyed from the hopper is distributed along the width of an intended ribbon or mat by means of two opposing screws or spreading conveyors or augers, and a free-floating screed profiles and compacts the asphalt material into a mat on the paving surface.

The operation of the paving machine and its components may be manually controlled by the operator(s) to dispense the asphalt material and create the mat on the paving surface. In many paving machines, systems are provided to automate and control the paving process for consistent operation of the paving machine for laying a uniform mat on the paving surface without defects compromising the integrity and longevity of the mat. The automation systems may include control over the speed of the paving machine, operation of the conveyors and augers to distribute the asphalt material, and vertical positioning and temperature control of the screed. The control settings may be established during an initial setup process for a paving job, such as the paving of a stretch of a highway or the paving of a parking lot.

During the paving process, the screed must be heated so that the hot paving material does not stick to the bottom surface as the screed passes over and compacts the mat. The screed has a plurality of electrical heating elements that heat the screed to the necessary temperature for paving. The heating elements receive electricity via relays from a generator of the paving machine. In most current paving machines, a power source, such as a gas or diesel internal combustion engine, has an output shaft driving a pump drive. The pump drive in turn drives multiple pumps and/or motors providing pneumatic, hydraulic and mechanical power to the various systems of the paving machine. One of the pumps or motors drives the generator supplying electricity to the screed heating elements. Most generators used in these applications provide alternating current (AC) power with frequencies that vary as the speed of the output shaft of the power source varies. An additional rectifier circuit or other signal conditioning arrangement is provided to convert the output of the generator to AC power having an approximately constant frequency.

The use of the string of interconnected components as described results in power losses and reduced efficiency that increase the cost of operating the paving machine. Some paving machine arrangements provide a more direct connection between a power source and a generator. For example, U.S. Pat. Appl. Publ. No. 2010/0296866, published on Nov. 25, 2010 and entitled, "Paver and Method," discloses a generator that is mounted either at the power take-off gear for the road paver's pumps or at a suspension in the chassis of the road paver, or at a console of the combustion engine of the road paver. The generator may be driven by a permanent drive connection, such as a belt drive or a drive shaft. However, the publication does not teach any alternate connection to heating elements of the road paver than that described above.

During operation of the paving machines having the screed heating arrangements described above, the screed temperature is maintained at the desired level as the mat is laid on the paving surface. Typically, each of the screed heating elements has a corresponding circuit breaker that trips in the event of a ground fault to prevent damage to the components. When a ground fault occurs, the circuit breaker trips without an indication being given to the operator that the corresponding heating element is not receiving power. The paving machine continues to lay the mat on the paving surface as the portion of the screed cools, and the operator may not identify the failure of heating element until portions of the mat are adversely affected by contact with the cooled portion of the screed.

In view of the inefficiencies and performance risks present in providing power to the screed heating elements in the present paving machines, a need exists for improved electrical power generation and transmission to the screed heating elements, and improved handling of ground fault situations to minimize the adverse affects on the mats being laid by the paving machines.

SUMMARY OF THE DISCLOSURE

In one aspect of the present disclosure, a paving machine for laying a mat of paving material on a paving surface is disclosed. The paving machine may include a tractor and a screed. The tractor may have a power source having an output shaft, a pump drive connected to the output shaft of the power source, a generator integrally installed with the pump drive and being operatively connected to the output shaft of the power source to drive a rotor of the generator and produce AC power, a first power converter operatively connected to the generator to receive the AC power produced by the generator, to convert the AC power to direct current (DC) power, and to output the DC power, and a tractor controller operatively connected to the generator to receive control signals, and operatively connected to the first power converter to transmit and receive control signals. The screed may include a zones power distribution box having a plurality of main zone trunk wires, and a plurality of screed heating elements operatively connected to the tractor controller to transmit control signals. The zones power distribution box may operatively connected to the tractor controller to transmit and receive control signals, and operatively connected to the first power converter to receive the DC power from the first power converter, wherein the DC power received at the zones power distribution box is distributed between the plurality of main zone trunk wires. Each of the plurality of main zone trunk wires from the zones power distribution box is operatively connected to a corresponding one of the plurality of screed heating elements to transfer the DC power from the zones power distribution box, and the plurality of screed heating elements produces heat to warm the screed to a predetermined paving temperature.

In another aspect of the present disclosure, a method for operating a paving machine to lay a mat of paving material on a paving surface is disclosed. The method may include operatively connecting an output shaft of a power source of the paving machine to an input shaft of a generator to drive a rotor of the generator and produce AC power, wherein the generator is integrally installed with a pump drive of the paving machine, outputting the AC power from the generator to a first power converter, converting the AC power to DC power at the first power converter, outputting the DC power from the first power converter to a zones power distribution box of a screed of the paving machine, distributing the DC power received at the zones power distribution box to a plurality of screed heating elements, and generating heat at the plurality of screed heating elements from the DC power received from the zones power distribution box to warm the screed to a predetermined paving temperature.

Additional aspects are defined by the claims of this patent.

DETAILED DESCRIPTION

Although the following text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

Figure 1:
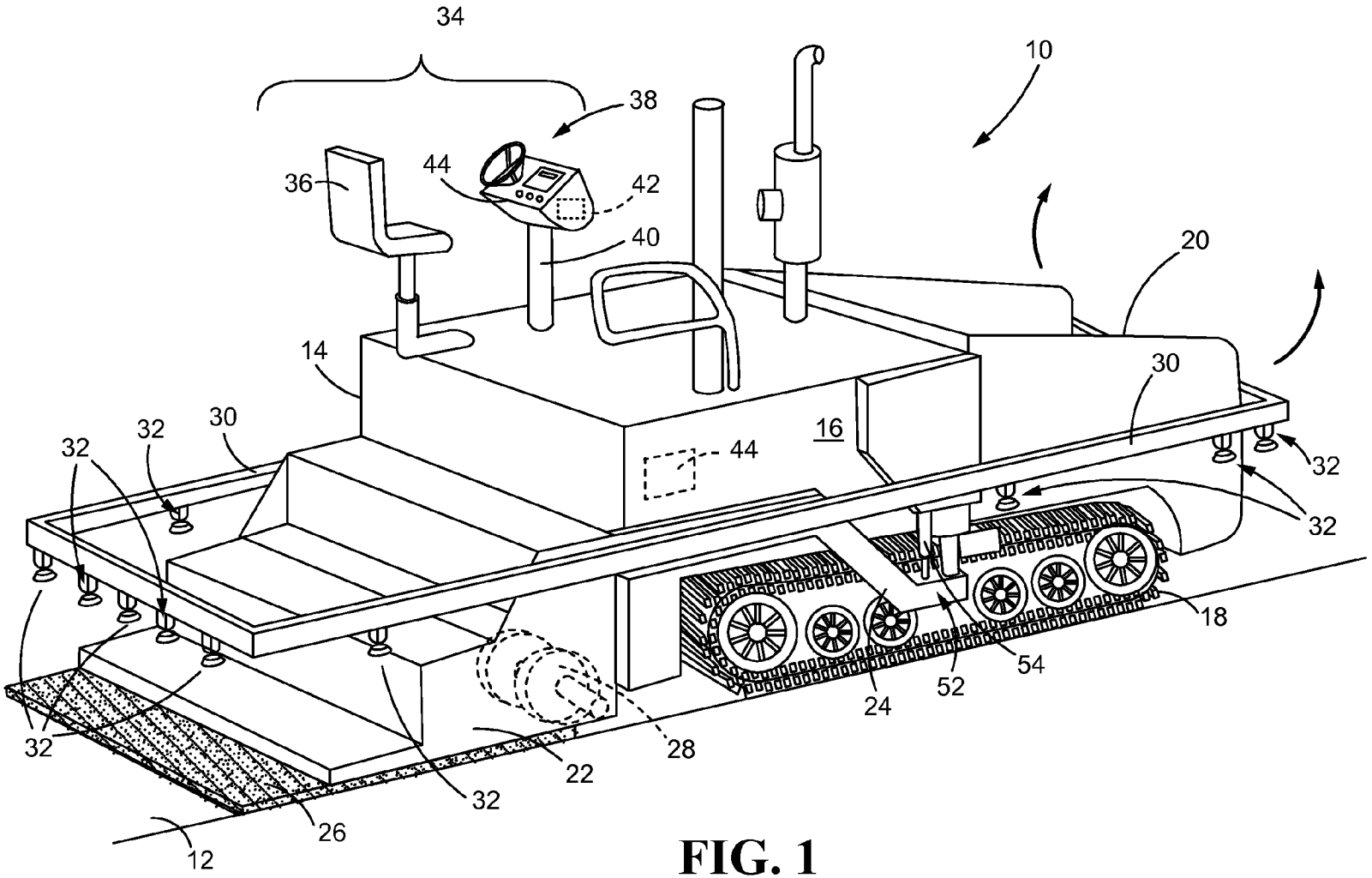
FIG. 1 is a perspective view of a paving machine.

FIG. 1 is an illustration of a paving machine 10. Although the paving machine 10 is depicted in the figures as an asphalt paver, the presently disclosed control system may be used on any kind of paving machine for any kind of paving material that may form a layer of material on a paving surface 12 and where power is supplied to screed heating elements. The paving machine 10 includes a tractor 14 having a power source 16, such as a gas turbine engine, a gas or diesel internal combustion engine, a motor or the like, one or more traction devices 18, and a hopper 20 for containing paving material. The traction devices 18 may be operatively coupled to the power source 16 by a transmission mechanism (not shown) to drive the traction devices 18 and propel the paving machine 10. Although the traction devices 18 are shown in the figures as tracks, the traction devices 18 could alternatively be wheels or any other type of traction devices. The traction devices 18 could also be combinations of different types of traction devices. For example, paving machine 10 could include both tracks and wheels.

The paving machine 10 also includes a screed 22 attached to tractor 14 by tow arms 24 and towed behind tractor 14 to spread and compact the paving material into a mat 26 on the paving surface 12. The screed 22 may include one or more augers 28 for spreading the paving material to the lateral extents of the screed 22. In addition, the paving machine 10 includes a sensor frame 30 attached to the screed 22 and/or to the tow arms 24. The sensor frame 30 may include one or more sensors 32 that may sense values of various parameters relating to the operation of the paving machine 10, such as the height of the paving machine 10 at various locations, and temperatures of the paving material, the screed 22 and the mat 26.

The paving machine 10 also includes an operator station 34 for one or more operators. The operator station 34 includes a seat 36 and an operation console 38 that may be mounted on a pedestal 40. The operator station 34 includes a tractor controller or electronic control module (ECM) 42 as well as a human-machine interface 44 for accepting user input and displaying information to the operator. The human-machine interface 44 may have a combination of buttons, switches, dials, levers, touch screens and other control devices that may allow the operator to input commands to the tractor ECM 42 for controlling the operation of the various components of the paving machine 10.

Figure 2:
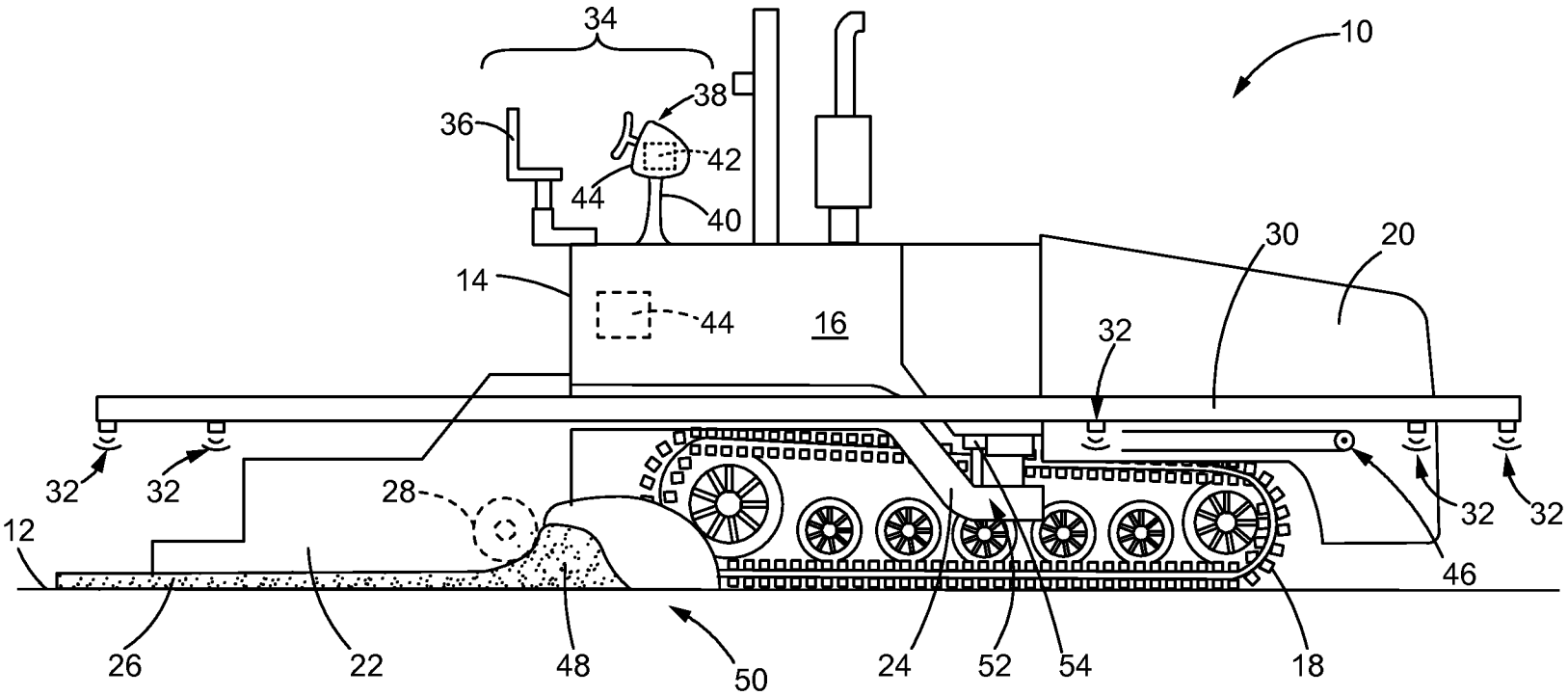
FIG. 2 is a side view of the paving machine of FIG. 1.

The hopper 20 of the paving machine 10 contains the paving material that is to be formed into the mat 26 on the paving surface 12. The paving material may be dumped into the hopper 20 at the front of the paving machine 10 from trucks that deliver the paving material to a work site. Referring to FIG. 2, the paving machine 10 may include one or more conveyors 46 at the bottom of the hopper 20. The conveyors 46 may be positioned side-by-side and run parallel to one another proximate the center of the hopper 20 along a midline of the paving machine 10. The hopper 20 is generally configured to feed the paving material from the sides of the hopper 20 toward the center and the conveyors 46 may transport paving material from the hopper 20 to the rear of the tractor 14 where it may be dropped behind the tractor 14 in front of the screed 22 and onto the paving surface 12 in a pile 48 (shown in a cut away portion 50 of FIG. 2). As the paving machine 10 travels forward, the pile 48 may be evenly spread and compacted by the heated screed 22. Some of the material at the outward sides of the hopper 20 may not feed down to the conveyors 46 and instead accumulates at the sides of the hopper 20. Funneling of the accumulated material to the conveyors 46 may be promoted by having the left and right sides of the hopper 20 articulate so that the sides may be raised by actuators (not shown) together or independently to cause the material to flow down to the conveyors 46 (motion indicated by arrows in FIG. 1).

The screed 22 spreads the pile 48 evenly and compacts the paving material into the mat 26 on the paving surface 12. The screed 22 is shown in the figures as a floating-type screed. However, the screed 22 may be any type of screed for any type of paving material. The screed 22 is attached to the tractor 14 at tow points 52 by the tow arms 24. The height of the screed 22 is adjusted by raising and/or lowering the tow arms 24 at the tow points 52 with screed height actuators 54. The screed height actuators 54 may be any suitable actuators, such as, for example, hydraulic cylinders. When the paving machine 10 is in motion, the screed 22 floats on a layer of paving material at a substantially consistent height relative to the height of the tow arms 24 at tow points 52. The operator is able to adjust the height of the screed 22 during the paving job via appropriate controls at the operation console 38 as discussed further below.

Figure 3:
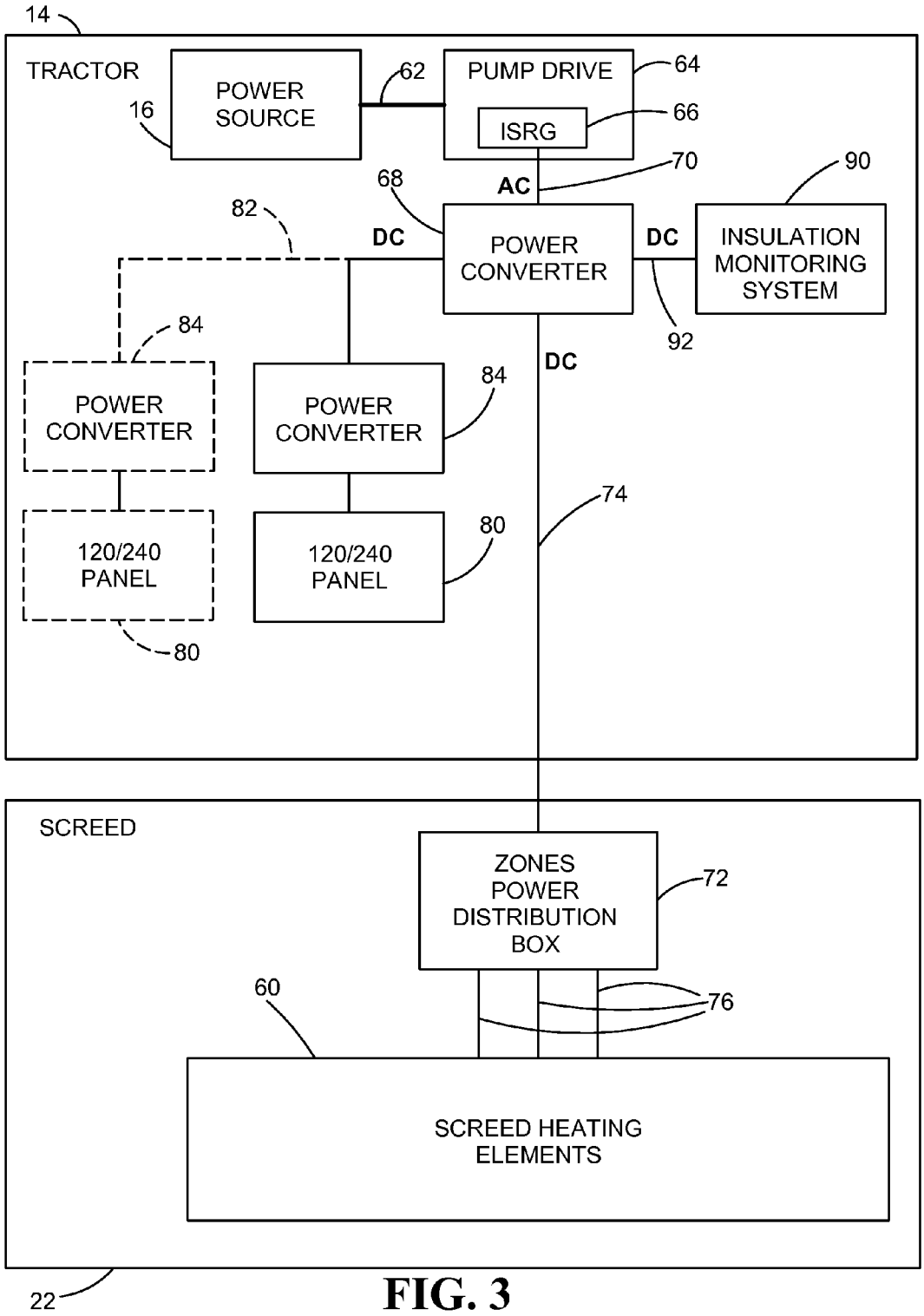
FIG. 3 is a schematic view of electrical power distribution components in accordance with the present disclosure implemented in the paving machine of FIG. 1.

The screed 22 is heated during the paving process so the paving material in the mat 26 does not stick to the bottom of the screed 22 and compromise the quality of the mat 26. FIG. 3 illustrates an arrangement in accordance with the present disclosure of electrical power distribution components of the paving machine 10 for generating electrical power and providing the electrical power to heating elements 60 of the screed 22 and other components of the tractor 14. Mechanical power output by the power source 16 is converted to electrical power that is usable by the screed heating elements 60. A rotating output shaft 62 of the power source 16 is connected to a pump drive 64 within the tractor 14. The pump drive 64 houses internal gear drives (not shown) that in turn have pumps and motors (not shown) coupled thereto. As the output shaft 62 of the power source 16 drives the gear drives of the pump drive 64, the pumps and motors generate hydraulic, pneumatic and mechanical power for various systems of the paving machine 10.

The pump drive 64 further includes an integrated generator (ISRG) 66 assembled with the pump drive 64. The integrated generator 66 has an input shaft (not shown) that is operatively coupled to the output shaft 62 of the power source 16 instead of being indirectly coupled to the output shaft 62 through one of the pumps or motors driven by the pump drive 64. The input shaft of the integrated generator 66 may be coupled directly to the output shaft 62 via a belt or intermediate drive shaft, or by one of the gear drives of the pump drive 64. Particular connection arrangements for converting rotation of the output shaft 62 of the power source 16 into rotation of the input shaft of the integrated generator 66 within the pump drive 64 will be apparent to those skilled in the art and are contemplated by the inventors as having use in paving machines 10 in accordance with the present disclosure. In the present embodiment, the integrated generator 66 may be a switched reluctance generator that may be, for example, of the type disclosed in Susitra et al., Switched Reluctance Generator—Modeling, Design, Simulation, Analysis and Control—A Comprehensive Review, Int'l J. Computer Appls., Vol. 1, No. 2, pp. 10-16 (2010) and Hrabovcova et al., Output Power of Switched Reluctance Generator with regard to the Phase Number and Number of Stator and Rotor Poles, Elec. & Elec. Eng'g, No. 3, pp. 25-30 (2011), which are expressly incorporated by reference herein. A switched reluctance generator such as those described in the references can provide more power in a smaller package relative to the currently used generators, thereby facilitating integration of the generator 66 with the pump drive 64.

Stand alone generators currently used in paving machines to provide electricity to screed heating elements produce a constant power output at a frequency that varies based on the speed of the pump or motor driving the stand alone generator. In order to produce power with generally constant output frequency, amperage and voltage, the pump and/or motor driving the generator is controlled to adjust to the speed of the power source 16 and drive the generator at a constant speed. In one type of arrangement, the motor has a speed sensor, and the pump up-strokes or down-strokes as necessary to keep the output pump speed driving the generator approximately constant.

In contrast to currently generator arrangements, precise control of the speed of the integrated generator 66, and correspondingly the output power, is not required in paving machines 10 in accordance with the present disclosure. An output AC power of the integrated generator 66 is connected to an input of a first power converter 68 via an AC electrical connection 70. The power converter 68 converts the AC power from the integrated generator 66 to DC power that is usable to power the screed heating elements 60. The power converter 68 is configured to create a constant output power over the range of frequencies, amperages and voltages of the AC power output by the integrated generator 66. The speed of the integrated generator 66 and the characteristics of the power output by the integrated generator 66 vary based on the speed of the output shaft. Despite the variations, the power converter 68 outputs power at the voltage necessary to operate the electrical components of the paving machine 10. With this configuration, the motor and pump driving the generator, and the corresponding control functionality required to maintain a constant speed of the generator, are eliminated in the paving machine 10, and the removal of the operational components further improves the efficiency realized by the paving machine 10.

The power converter 68 includes a first DC power output connected to a power input of a zones power distribution box 72 of the screed 22 via a first DC electrical connection 74. The zones power distribution box 72 may control the distribution of the DC power received from the power converter 68 between the screed heating elements 60 to which the zones power distribution box 72. The heated portion of the screed 22 may be separated into a plurality of zones, with each containing one or more of the screed heating elements 60. The zones power distribution box 72 includes a plurality of main zone trunk wires 76, with each main zone trunk wire 76 connecting one of the zones of the screed 22 and the corresponding heating element(s) 60 to the zones power distribution box 72 to receive DC power from the zones power distribution box 72 when the screed 22 is to be heated. In many implementations, the screed 22 may be provided with lateral extensions or connections for lateral screed extensions for laying wider mats 26 on the paving surface 12. The screed heating elements 60 of the extensions may receive DC power via additional main zone trunk wires 76 from the zones power distribution box 72.

The power converter 68 supplies power to other components of the tractor 14 and screed 22. For example, in work areas where it is desirable or required to perform the paving process at night, it may be desirable to mount lights on the paving machine 10 to illuminate the work area. Power for the lights may be provided by an electrical outlet panel 80, such as a 120/240 VAC panel, that is connected to the power converter 68 in parallel with the zones power distribution box 72 of the screed 22. A second DC electrical connection 82 from the power converter 68 is connected to an electrical input to a second power converter 84 to convert the output DC power from the power converter 68 into the AC power required for the outlet panel 80. If necessary, additional combinations of outlet panels 80 and power converters 84 may be connected to the second DC electrical connection 82 to provide outlets for powering additional lamps and appliances that may be necessary for executing the paving process.

As in any electrical system, ground faults and other abnormal situations can occur that can cause damage to the electrical components of the paving machine 10. Identification of and reaction to these situations is necessary avoid the potential damage to the electrical components. In current paving machines, fuses, circuit breakers and similar devices are used that blow, trip or otherwise interrupt the continuity of the electrical flow when a fault condition occurs. Such devices do not otherwise manage the fault condition, and the fault condition is only identified after the operator, maintenance technician or the like determine that a corresponding component of the paving machine is not functioning. In paving machines 10 in accordance with the present disclosure, a insulation monitoring system 90 is provided to constantly monitor the entire electrical system of the paving machine 10 and manage the occurrences of fault conditions, shut down the paving machine 10 or affected components thereof if necessary, and provide notification to the operator of the paving machine 10 or others responsible for maintenance and operation of the paving machine 10 as will be described more fully below. The insulation monitoring system 90 may be a stand-alone unit or a module within the tractor ECM 42, and receive DC power from the power converter 68 over a third DC electrical connection 92 arranged in parallel with the electrical connections 74, 82. In order to ensure safe operation of the power converter 68 and the insulation monitoring system 90, the converter 68 and insulation monitoring system 90 may be housed in an insulated enclosure providing an intrinsically safe environment.

Figure 4:
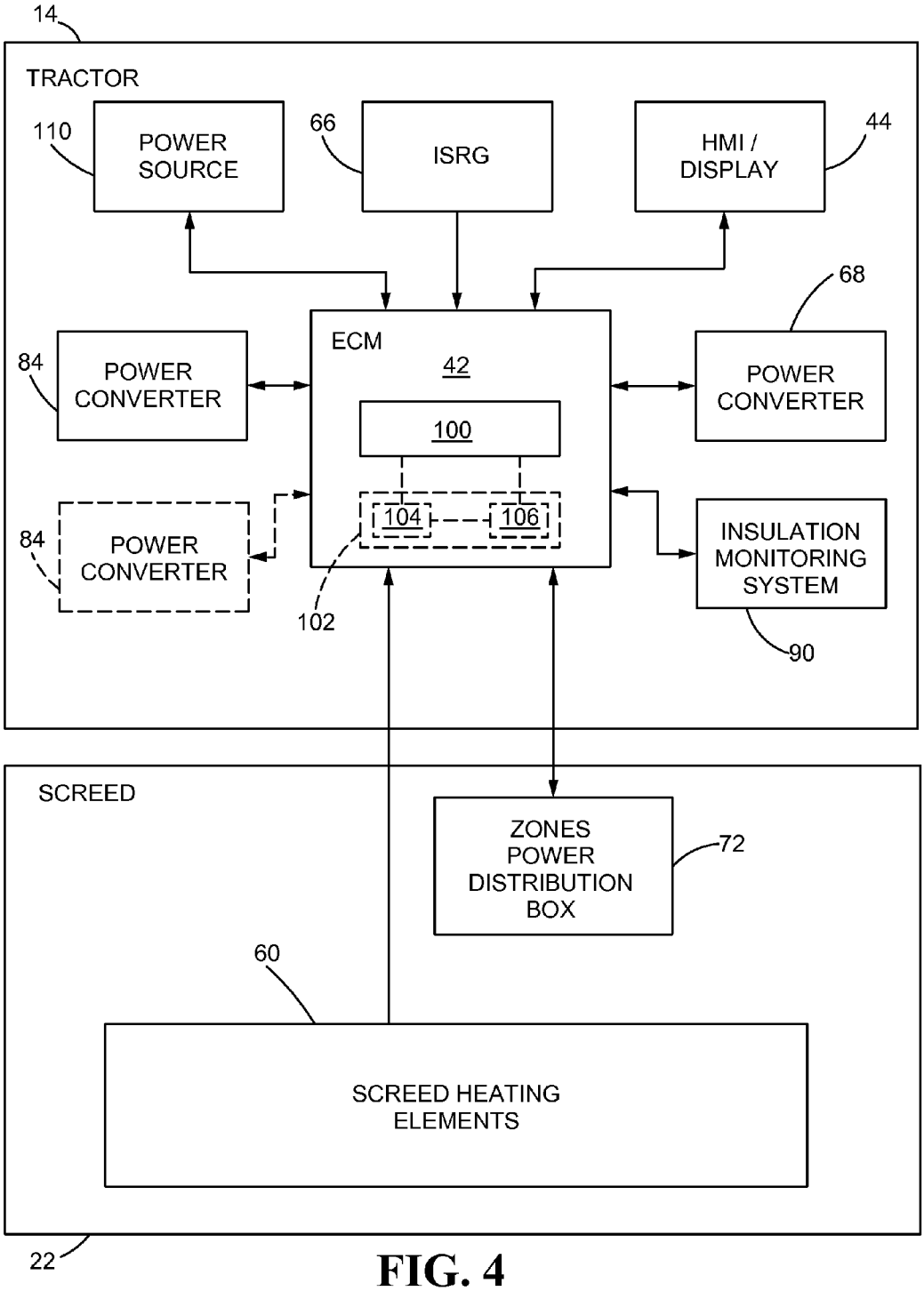
FIG. 4 is schematic view of the screed heat control components in accordance with the present disclosure implemented in the paving machine of FIG. 1.

Referring now to FIG. 4, the control elements operable to regulate the temperature of the screed 22, to distribute power from the integrated generator 66, and to detect and handle fault conditions are illustrated schematically. As discussed above, the tractor ECM 42 resides in the tractor 14 of the paving machine 10. The tractor ECM 42 includes a microprocessor 100 for executing a specified program, which controls and monitors various functions associated with the paving machine 10. The microprocessor 100 includes a memory 102, such as read only memory (ROM) 104, for storing a program or programs, and a random access memory (RAM) 106 which serves as a working memory area for use in executing the program(s) stored in the memory 102. Although the microprocessor 100 is shown, it is also possible and contemplated to use other electronic components such as a microcontroller, an ASIC (application specific integrated circuit) chip, or any other integrated circuit device.

The tractor ECM 42 electrically connects to the human-machine interface 44, the integrated generator 66, the power converter 68, the zones power distribution box 72, the power converter(s) 84 and the insulation monitoring system 90. The tractor ECM 42 exchanges control signals with the components 44, 66, 68, 72, 84, 90 to monitor and control the operation of the paving machine to distribute the power from the integrated generator 66 to the screed heating elements 60 and to other components. The screed heating elements 60, the integrated generator 66, and the power converter 68 include thermocouples or other heat sensing elements capable of measuring the temperature of the corresponding component and transmitting a temperature signal to the tractor ECM 42. In alternate embodiments, one or more of the thermocouples may be replaced by a temperature estimating algorithm of the tractor ECM 42 the determines a current temperature of the corresponding electrical component based on the past and present operating conditions of the component. For example, the temperature of the integrated generator 66 may be determined based on the speed of the generator 66 and the power drawing by the electrical components of the paving machine 10.

The zones power distribution box 72, the power converter(s) 84 and the insulation monitoring system 90 are capable of two-way communications with the tractor ECM 42 to provide values of operating parameters to the tractor ECM 42 and receive control signals from the tractor ECM 42 to control the operation of the components 72, 84, 90. The human-machine interface 44 may receive and display information from the tractor ECM 42 relating to the functioning of the paving machine 10. The information may be output for the operator in any appropriate sensory perceptible format such as audio output and visual output in the form of status indicator lamps, alphanumeric displays and the like as may be appropriate. The human-machine interface 44 may further provide input capabilities for the operator to input commands to the tractor ECM 42 for controlling the operation of the components of the paving machine 10.

The paving machine 10 may further include a power source controller or ECM 110 operatively connected to the power source 16 and to the tractor ECM 42. The power source ECM 110 controls the operation of the power source 16 to ensure sufficient power is generated and output to operate the systems of the paving machine 10, including the screed heating elements 60. As part of the power source control strategy, the tractor ECM 42 may determine when more or less power is required for the screed heating elements 60 and transmit control signals to the power source ECM 110 to vary the output of the power source 16. In response to receiving the control signals from the tractor ECM 42, the power source ECM 110 changes the power output of the power source 16 as necessary to meet the requirements of the screed heating elements 60. The power source ECM 110 may also transmit information back to the tractor ECM 42 regarding the operational status of the power source 16 for use as necessary by the tractor ECM 42.

INDUSTRIAL APPLICABILITY

The paving machine 10 in accordance with the present disclosure provides power to the screed heating elements 60 to heat the screed 22 in an efficient and safe manner. At the beginning of a paving job, the operator may start the paving machine 10 by turning on the power source 16 via controls at the human-machine interface 44. The output shaft 62 of the power source 16 rotates and in turn drives the gear drives of the pump drive 64, if engaged, and an input shaft of the integrated generator 66. Without having a pump or motor interposed between the power source 16 and the integrated generator 66, significant efficiency gains may be realized. In some implementations, the efficiency increases from approximately 70% where a generator is driven by a pump or motor to greater than 90% with the direct drive of the integrated generator 66 by the power source 16.

As the integrated generator 66 is driven by the power source 16, AC power is generated by the integrated generator 66 and output to the power converter 68 for conversion into DC power that is usable by the electrical components of the paving machine 10. Depending on the stage of the paving process, the various components may be powered by or not powered by the power converter 68. For example, at the beginning of the paving project, the paving machine 10 may be travelling to the paving surface 12 and not yet laying the mat 26. The screed height actuators 54 may be actuated to raise the screed 22 off the ground as the tractor 14 travels to the paving surface 12. Prior to arriving at the paving surface 12, it may not be appropriate or desired to heat the screed 22. The human-machine interface 44 may include a paving mode selection control that may be set to a non-paving mode indicating that the mat 26 is not being laid. The tractor ECM 42 receives a paving mode control signal from the human-machine interface 44 and, in response, may turn off the screed heating elements 60. The tractor ECM 42 may transmit a signal to the power converter 68 to cut off power to the zones power distribution box 72, transmit a signal to the zones power distribution box 72 to cut off power to the screed heating elements 60, or both, so the screed heating elements 60 do not heat the screed 22.

The operator may also be able to selectively control whether AC power from the power converter 84 is supplied to the outlet panel(s) 80. If no lights or other appliances will be plugged into the outlets, the operator may set an appropriate outlet panel control at the human-machine interface 44 to an "OFF" position that triggers the tractor ECM 42 to cause the power converter 84 to cut off power to the outlet panel(s) 80. When desired to make use of the outlet panel(s) 80, the operator may set the outlet panel control to an "ON" position. The tractor ECM 42 detects the "ON" setting of the outlet panel control and transmits signals causing the power converter(s) 84 to activate the outlet panel(s) 80.

Once the paving machine 10 is in place at the paving surface 12, the operator may set the paving mode selection control to the paving mode to begin the paving process. In response to detecting selection of the paving mode at the human-machine interface 44, the tractor ECM 42 initiates the heating of the screed 22 by the screed heating elements 60. The tractor ECM 42 transmits control signals to the power converter 68 and zones power distribution box 72 causing the DC power output by the power converter 68 to the zones power distribution box 72 to be distributed between the screed heating elements 60. As the screed 22 heats up, the thermocouple or other temperature sensing device in the screed 22 transmits a screed temperature signal as feedback to the tractor ECM 42. The tractor ECM 42 receives the screed temperature signal and compares the current temperature of the screed 22 to a predetermined screed paving temperature.

During the warm-up period, the current screed temperature will be significantly lower than the screed paving temperature. To rapidly raise the screed temperature and avoid undue delays in the paving process by waiting for the screed 22 to heat, the tractor ECM 42 may transmit a power requirement control signal to the power source ECM 110 to cause the power source ECM 110 to increase the power output of the power source 16 and, correspondingly, the AC power output by the integrated generator 66. The AC power increase is possible due to the characteristics of the integrated generator 66 wherein the output power is variable based on the speed of the input shaft. Where the power source is an engine, the power output increase is achieved by increasing the engine speed. The increased AC power from the integrated generator 66 is provided as increased DC power to the screed heating elements 60 to accelerate the heating of the screed 22 to the screed paving temperature. As the screed temperature approaches the screed paving temperature as indicated by the screed temperature signal, the tractor ECM 42 transmits an updated power requirement control signal to the power source ECM 110 to cause the power source ECM 110 to reduce the power output of the power source 16 so that the screed heating elements 60 do not overheat the screed 22.

After the screed 22 is heated to the screed paving temperature, the operator operates the paving machine 10 to produce the mat 26 on the paving surface 12. The screed temperature sensing device continues transmitting updated screed temperature signals to the tractor ECM 42. The tractor ECM 42 compares the current screed temperature from the update screed temperature signals to an acceptable range of screed temperatures about the screed paving temperature. Whenever the current screed temperature falls outside the acceptable range, the tractor ECM 42 transmits control signals to the power converter 68, to the zones power distribution box 72 and, if necessary, to the power source ECM 110 to vary the power distributed to the screed heating elements 60 as necessary to bring the screed temperature back within the acceptable range of screed temperatures.

In some implementations of the paving machine 10, the screed 22 may have a single temperature sensor located at an appropriate position for sensing the current screed temperature necessary for controlling the screed heating elements 60. In other implementations, the screed 22 may have multiple temperature sensors each providing screed temperature signals to the tractor ECM 42. The screed temperature sensors may be distributed across screed 22 so that the temperature may be controlled for individual sections of the screed 22. For example, a screed temperature sensor may be provided for each zone of the screed 22, and the tractor ECM 42 may independently evaluate the temperature of each zone and control the temperature of the zone by transmitting control signals to the zones power distribution box 72 to provide or cover power to zone or the corresponding main zone trunk wire 76. Similar control may be implemented by providing separate temperature sensors at each of the screed heating elements 60.

The integrated generator 66 generates heat as it is driven by the power source 16 to produce electrical power for the electrical components to the paving machine 10. Excessive heat can damage the integrated generator 66. Consequently, integrated generator 66 is provided with one or more temperature sensors, such as resistive temperature detectors, that measure the temperature of the integrated generator 66 and transmit generator temperature signals to the tractor ECM 42. Alternately, the tractor ECM 42 is programmed with a temperature estimating algorithm to determine the current generator temperature. The tractor ECM 42 compares the current generator temperature to a predetermined maximum generator temperature to determine if a risk exists of the integrated generator 66 overheating. If the current generator temperature exceeds the maximum generator temperature, it is necessary to reduce the temperature of the integrated generator 66 by de-rating the integrated generator 66 by reducing the power drawn from the integrated generator 66. The de-rating of the integrated generator 66 may be accomplished by transmitting a control signal from the tractor ECM 42 to the power converter 68 to reduce the power drawn from the integrated generator 66 and converted into DC power. After the generator temperature drops safely below the maximum generator temperature, the tractor ECM 42 may transmit a further control signal to the power converter 68 to convert the normal amount of electrical power drawn from the integrated generator 66. In a similar manner, the tractor ECM 42 may prevent overheating of the power converter 68 by receiving converter temperature signals from temperature sensors at the power converter 68 or otherwise determines the current temperature of the power converter 68, comparing the converter temperature to a maximum converter temperature, and controlling the amount of power converted by the power converter 68 to maintain the converter temperature below the maximum converter temperature.

The insulation monitoring system 90 is configured to identify and manage fault conditions occurring in the paving machine 10 in real-time. Current sensors are provided throughout the electrical system of the paving machine in the various electrical components. For example, a current sensor may be provided for each zone of the screed 22 to detect fault conditions involving the screed heating elements 60. The current sensors provide current measurement signals to the tractor ECM 42 via the electrical connection of the zones power distribution box 72, and the current measurement signals are evaluated by the insulation monitoring system 90. The insulation monitoring system 90 evaluates the current measurement signals against a predetermined maximum current level to detect ground faults occurring at any of the electrical components of the tractor 14 or the screed 22. If a ground fault is detected by the insulation monitoring system 90, the insulation monitoring system 90 further evaluates the ground fault status of the particular component and the other components of the paving machine 10 to determine the appropriate response.

Upon detecting the ground fault condition, the tractor ECM 42 determines whether multiple ground faults are occurring simultaneously. If no other ground faults are occurring, i.e., no other current measurement signals exceed the predetermined maximum current level, it may not be necessary to take corrective action on the component transmitting the current measurement signal. Instead, the tractor ECM 42 may transmit an operator notification signal to an output device of the human-machine interface 44 to generate a sensory perceptible ground fault notification for the operator. The notification may be an audible notification output from a speaker, a visual notification output by illuminating a fault indicator light or displaying a text message on a display screen, or combination thereof audible and visual notifications. The notification alerts the operator to the occurrence of the fault conditions that may not be fatal to the quality of the mat 26 and allows the operator to determine whether immediate corrective actions are necessary. This response by the insulation monitoring system 90 and the tractor ECM 42 may be appropriate for DC ground faults and AC ground faults where the current measurement signal does not exceed a predetermined damage threshold current above which the ground fault can cause damage to the component.

If two or more ground faults are occurring simultaneously, it may be necessary for the tractor ECM 42 to respond by shutting down the components experiencing the ground faults, or by shutting down the entire electrical system of the paving machine 10. For a complete shutdown, the tractor ECM 42 may transmit a ground fault shutdown signal to the power converter 68 to shut off the power converter 68 and correspondingly the electrical system of the paving machine 10 to prevent damage to the components and to avoid the risk of laying the mat 26 with defects. For component level shutdowns, the ground fault shutdown signal may be transmitted instead to the specific faulting component (s), such as the zones power distribution box 72 to cut off the power to the box 72 and to the screed heating elements 60. Additionally, the tractor ECM 42 may transmit an operator shutdown notification signal to the output device of the human-machine interface 44 to generate a shutdown notification for the operator indicating that the paving process should be stopped and the fault conditions resolved before the paving machine 10 can be operated to lay the mat 26. Even where only a single ground fault is occurring, it may be necessary to perform a component or complete shutdown where the current measurement signal from the faulting component represents an AC ground fault having a current that exceeds the predetermined damage threshold current. This may be the case where the ground fault is detected on the AC electrical connection 70 between the integrated generator 66 and the power converter 68. When the dangerous AC ground fault is detected, the tractor ECM 42 transmits the ground fault shutdown signal to the power converter 68 to effectively shut down the entire electrical system of the paving machine 10. This strategy for detecting and reacting to ground faults is superior to fault condition handling in present paving machines wherein a circuit breaker trips in the event of a fault condition without notification to the operator, and the paving machine continues to operate until the operator notices that all or a portion of the screed 22 has cooled and the paving material is sticking to the surface of the screed 22.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A paving machine for laying a mat of paving material on a paving surface, the paving machine comprising:

a tractor comprising:

a power source having an output shaft, a pump drive connected to the output shaft of the power source, a generator integrally installed with the pump drive and being operatively connected to the output shaft of the power source to drive a rotor of the generator and produce alternating current (AC) power, a first power converter operatively connected to the generator to receive AC power produced by the generator, to convert the AC power to direct current (DC) power, and to output DC power, and a tractor controller operatively connected to the generator to receive control signals, and operatively connected to the first power converter to transmit and receive control signals; and a screed comprising:

a zones power distribution box having a plurality of main zone trunk wires, the zones power distribution box being operatively connected to the tractor controller to transmit and receive control signals, and being operatively connected to the first power converter to receive the DC power from the first power converter, wherein the DC power received at the zones power distribution box is distributed between the plurality of main zone trunk wires, and a plurality of screed heating elements operatively connected to the tractor controller to transmit control signals, wherein each of the plurality of main zone trunk wires from the zones power distribution box is operatively connected to a corresponding one of the plurality of screed heating elements to transfer the DC power from the zones power distribution box, and wherein the plurality of screed heating elements produces heat to warm the screed to a predetermined paving temperature.

2. The paving machine of claim 1, wherein the tractor comprises a insulation monitoring system operatively connected to the tractor controller to transmit and receive control signals, wherein the generator, the first power converter, the zones power distribution box, and the plurality of screed heating elements transmit current measurement signals to the tractor controller, wherein the insulation monitoring system is configured to compare current levels in the current measurement signals to a predetermined maximum current level, and to determine an occurrence of a first ground fault at one of the generator, the first power converter, the zones power distribution box and the plurality of screed heating elements if a current level in one of the current measurement signals is greater than the predetermined maximum current level.

3. The paving machine of claim 2, wherein the insulation monitoring system is configured to determine whether additional ground faults are occurring in response to determining the occurrence of the first ground fault, and wherein the tractor controller is configured to output an operator notification signal in response to the insulation monitoring system determining that a number of ground faults detected by the insulation monitoring system does not exceed a predetermined number of ground faults required to cut off power to the ones of the generator, the first power converter, the zones power distribution box and the plurality of screed heating elements transmitting current measurement signals causing detection of the ground faults.

4. The paving machine of claim 3, wherein the tractor comprises an output display operatively connected to the tractor controller, wherein the tractor controller outputs the operator notification signal to the output display, and the output display outputs a sensory perceptible ground fault notification in response to receiving the operator notification signal.

5. The paving machine of claim 3, wherein the tractor controller is configured to shut off the ones of the generator, the first power converter, the zones power distribution box and the plurality of screed heating elements transmitting current measurement signals causing the detection of the ground faults in response to the insulation monitoring system determining that the number of ground faults detected by the insulation monitoring system is equal to the predetermined number of ground faults required to cut off power.

6. The paving machine of claim 2, wherein the tractor controller is configured to shut off the one of the generator, the first power converter, the zones power distribution box and the plurality of screed heating elements transmitting current measurement signals causing detection of the first ground fault in response to determining that the first ground fault is an AC current ground fault and that the current level in one of the current measurement signals causing the AC current ground fault is greater than a predetermined damage threshold current level that is greater than the predetermined maximum current level.

7. The paving machine of claim 1, wherein the tractor comprises:

a second power converter operatively connected to the tractor controller to transmit and receive control signals, and operatively connected to the first power converter, wherein the second power converter is configured to receive the DC power from the first power converter, to convert the DC power to AC power, and to output the AC power; and an outlet panel having a plurality of AC power outlets, wherein the outlet panel is operatively connected to the second power converter and is configured to receive the AC power output from the second power converter and to output the AC power at the plurality of AC power outlets.

8. The paving machine of claim 1, wherein the tractor comprises a power source controller operatively connected to the power source and to the tractor controller, wherein the tractor controller is configured to determine a power need for components of the tractor and the screed, to determine a power resource power requirement based on the power need for the components, and to output a power source power requirement signal to the power source controller, and wherein the power source controller is configured to receive the power source power requirement signal from the tractor controller, and to cause the power source to output power based on a value of the power source power requirement signal.

9. The paving machine of claim 8, wherein the power source is an engine, wherein the power source power requirement signal is a desired engine speed for the engine required to produce a power source power requirement, and wherein the power source controller causes the engine to operate at the desired engine speed in response to receiving the power source power requirement signal.

10. The paving machine of claim 8, wherein the tractor controller is configured to determine a generator temperature, to compare a value of the generator temperature to a predetermined maximum generator temperature, and to transmit the power source power requirement signal to the power source controller having a value to cause the power source to reduce power output by the power source in response to determining that the value of the generator temperature is greater than the predetermined maximum generator temperature.

11. The paving machine of claim 1, wherein the generator comprises a switched reluctance generator.

12. A method for operating a paving machine to lay a mat of paving material on a paving surface, the method comprising:

operatively connecting an output shaft of a power source of the paving machine to an input shaft of a generator to drive a rotor of the generator and produce alternating current (AC) power, wherein the generator is integrally installed with a pump drive of the paving machine;

outputting AC power from the generator to a first power converter;

converting the AC power to direct current (DC) power at the first power converter;

outputting DC power from the first power converter to a zones power distribution box of a screed of the paving machine;

distributing the DC power received at the zones power distribution box to a plurality of screed heating elements; and generating heat at the plurality of screed heating elements from the DC power received from the zones power distribution box to warm the screed to a predetermined paving temperature.

13. The method of claim 12, comprising:

detecting a first ground fault occurring at at least one of the generator, the first power converter, the zones power distribution box and the plurality of screed heating elements, wherein the first ground fault occurs when a current level at one of the generator, the first power converter, the zones power distribution box and the plurality of screed heating elements is greater than a predetermined maximum current level.

14. The method of claim 13, comprising:

determining whether additional ground faults are occurring in response to detecting the first ground fault; and outputting an operator notification signal to human-machine interface device of the paving machine in response to determining that a number of ground faults detected does not exceed a predetermined number of ground faults required to cut off power to the ones of the generator, the first power converter, the zones power distribution box and the plurality of screed heating elements.

15. The method of claim 14, comprising outputting a sensory perceptible ground fault notification from the human-machine interface device in response to receiving the operator notification signal.

16. The method of claim 14, comprising shutting off the ones of the generator, the first power converter, the zones power distribution box and the plurality of screed heating elements causing detection of the ground faults in response to determining that the number of ground faults detected is equal to the predetermined number of ground faults required to cut off power.

17. The method of claim 13, comprising shutting off the one of the generator, the first power converter, the zones power distribution box and the plurality of screed heating elements having the current level causing detection of the first ground fault in response to determining that the first ground fault is an AC current ground fault and that the current level causing the AC current ground fault is greater than a predetermined damage threshold current level that is greater than the predetermined maximum current level.

18. The method of claim 12, comprising:

outputting the DC power from the first power converter to a second power converter of the paving machine;

converting the DC power to AC power at the second power converter;

outputting the AC power from the second power converter to an outlet panel having a plurality of AC power outlets.

19. The method of claim 12, comprising:

determining a power need for components of the paving machine;

determining a power resource power requirement based on the power need for the components; and causing the power source to output power based on a value of a power source power requirement.

20. The method of claim 19, wherein the power source is an engine, wherein the power source power requirement is a desired engine speed for the engine required to produce the power source power requirement, and wherein the method comprises causing the engine to operate at the desired engine speed in response to the power source power requirement.

21. The method of claim 19, comprising:

determining a value of a generator temperature for the generator;

comparing a value of the generator temperature to a predetermined maximum generator temperature; and causing the power source to reduce power output by the power source in response to determining that the value of the generator temperature is greater than the predetermined maximum generator temperature.

22. The method of claim 12, wherein the generator comprises a switched reluctance generator.

* * * * *